United States Patent [19]

Sloan

[11] 3,957,402

[45] May 18, 1976

[54] DEWATERING PUMP ASSEMBLY HAVING A HEAT EXCHANGER

[76] Inventor: Albert H. Sloan, 4201 Kean Road, Fort Lauderdale, Fla. 33314

[22] Filed: Feb. 6, 1975

[21] Appl. No.: 547,378

Related U.S. Application Data

[62] Division of Ser. No. 415,997, Nov. 15, 1973, Pat. No. 3,910,728.

[52] U.S. Cl. ..... 417/367; 415/178

[51] Int. Cl.[2] ..... F04B 17/00

[58] Field of Search ..... 417/366, 367, 375, 390; 165/122; 415/178

[56] References Cited

UNITED STATES PATENTS

| | | | |
|---|---|---|---|
| 1,242,961 | 10/1917 | Mansell et al. | 165/122 |
| 1,866,846 | 7/1932 | Fink | 165/122 |
| 2,346,372 | 4/1944 | Foottit | 417/375 |
| 2,593,729 | 4/1952 | Coberly | 417/390 |
| 3,398,694 | 8/1968 | Lerch | 417/375 |

*Primary Examiner*—William L. Freeh
*Assistant Examiner*—G. P. La Pointe
*Attorney, Agent, or Firm*—James E. Nilles

[57] ABSTRACT

A dewatering pump assembly for water pumping apparatus for pumping water from excavations or other holes in the ground and upwardly to a more or less remote discharge area. The apparatus finds particular utility for use, for example, by contractors, utility companies, or the like, and includes a power source, preferably mobile or easily transportable, such as an internal combustion engine or an electric motor or other power sources. A pressure fluid tank assembly and a pressure fluid pump is connected directly to the power source, and a water pump assembly is located down in the water at the bottom of the hole or excavation and includes a housing in which an impeller, a fluid motor, and the connecting drive shaft all are located. The fluid pressure pump which is driven directly by the power source is connected by long flexible conduits to the motor of the pump assembly. The pump assembly includes a heat exchanger which is secured on the lower end of assembly and the pressure fluid conduits act to convey a portion of the pressure fluid to and from the heat exchanger to thereby cool the pressure fluid. The heat exchanger is located strategically in the water being pumped to thereby efficiently transfer heat from the pressure fluid to the water being pumped.

7 Claims, 4 Drawing Figures

DEWATERING PUMP ASSEMBLY HAVING A HEAT EXCHANGER

RELATED COPENDING APPLICATION

This is a divisional patent application of U.S. Ser. No. 415,997, filed Nov. 15, 1973, entitled "Dewatering Pumping Apparatus" which issued on Oct. 7, 1975, as U.S. Pat. No. 3,910,728.

BACKGROUND OF THE INVENTION

This invention pertains to dewatering pumping apparatus, for pumping water out of excavations, other holes in the ground, or emptying large tanks or the like.

These prior art pumps have a dewatering pump assembly down in the water in the hole being excavated and utilize a pressure fluid driven motor. Often these motors become heated excessively and must be cooled.

SUMMARY OF THE INVENTION

The present invention provides dewatering pumping apparatus including a dewatering pump assembly which has a heat exchanger secured thereto and which is located in the water being pumped. The heat exchanger receives the high pressure fluid which drives a fluid motor of the pump assembly and cools the pressure fluid as it is circulated between the motor and the pressure pump that is located at a remote distance.

These and other objects and advantages of the present invention will appear hereinafter as this disclosure progresses, reference being had to the accompanying drawings.

DESCRIPTION OF A PREFERRED EMBODIMENT

General Organization

Figure 1:
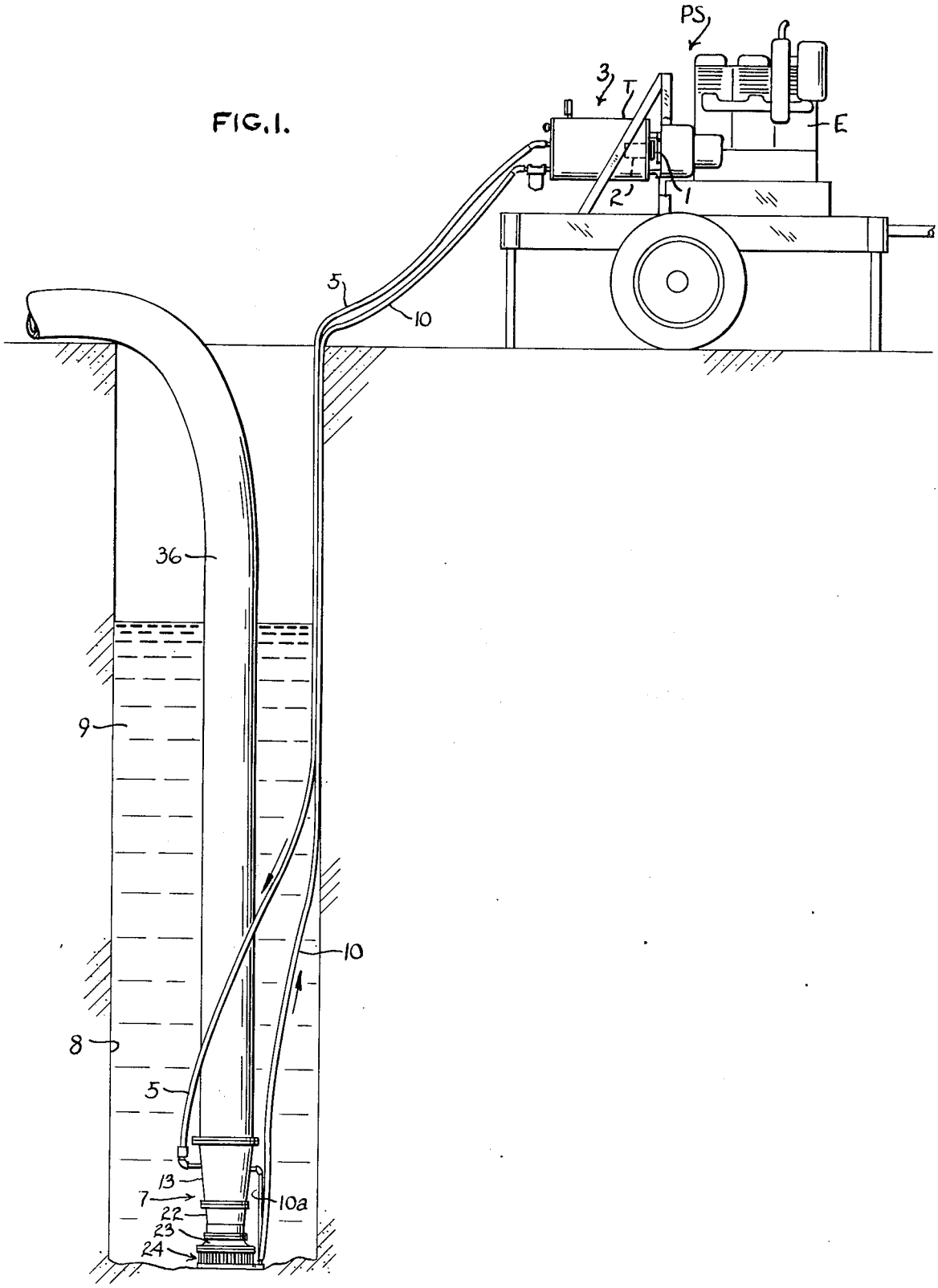
FIG. 1 is an elevational view of dewatering pumping apparatus which is used in the present invention, certain parts being shown as broken away or removed for the sake of clarity.

The general arrangement of the overall pumping apparatus includes a mobile power source PS comprising, for example, an internal combustion engine E, having a conventional flywheel 1 to which a positive displacement, pressure fluid pump 2 is attached for being driven by the engine. The power source PS may be one of a variety of different types or sizes, depending on the power requirements, sizes or types of the pump assembly required for the conditions encountered. The power source may be a four or six cylinder, internal combustion engine, for example, and is highly mobile, and is located up at normal ground level.

The fluid pump 2 is located together with other elements in a novel tank assembly 3, mounted by stand-off brackets 4 on the mobile power source, and which tank assembly contains various other components to be later described in detail. The fluid pump 2 directs pressurized fluid through a long flexible conduit 5 to a water pump assembly 7 which is located in the bottom of an excavation 8 and, more precisely, directly in the water to be pumped from the excavation. Another conduit 10 returns the pressure fluid back up to the tank assembly 3 on the power source PS.

Water Pump Assembly

The water pump assembly includes a positive displacement pressurized fluid motor 12 which is located in a tubular discharge housing 13 of the pump assembly 7. A heat exchanger HE is secured on the lower end of the assembly. The pressure fluid conduit 5 directs pressure fluid from the fluid pump 2 to the fluid motor 12. After passing through the motor, the fluid is directed via conduit 10*a* to the heat exchanger.

The heat exchanger is fabricated from steel plates and is generally hollow so as to define a chamber 9 and in which baffle plates 11 are located so that the pressure fluid is directed into the chamber 9 via conduit 10*a* and is caused to circulate thoroughly in the chamber to effect cooling. The heat exchanger is located in the coolest part of the water being pumped and is therefore very effective in cooling the pressure fluid after it has passed through the fluid motor 12. The fluid then is returned via conduit 10 to the fluid pump.

In addition to the discharge housing 13, the pump assembly 7 also includes a bearing and stator housing 22 which houses stators 33, a concentric pump shaft and bearing housing 29, and an impeller 34. The assembly also includes a stator housing 23 containing stators 35 and located generally near the intake of the pump assembly 7, and an endmost water intake section 24. The intake section shown has an end closure plate 24*a* and an open grill 24*b* around its periphery for the entry of material such as water, sand, sludge, etc. to be pumped. Annular flanges 25, 26 and 27 are provided around the peripheries of the housings 22, 23 and section 24, respectively, and through which flanges the bolt means 28 extend to detachably hold the housings and intake section together. This flange construction and bolt means between the housings and intake section, permits various housings to be assembled together, including different type intake sections to be utilized depending on the material to be pumped, that is to say, depending on whether "trash", such as water and sand and/or rocks, or other material is to be pumped.

As previously mentioned, the pump assembly 7 includes a pump shaft and bearing housing 29 mounted concentrically within the bearing and stator housing 22. This housing 29 extends through a central stator hub 22*a* of the stators 33 and is connected by bolt means 30 to the flange 31 of the motor 12. Within the bearing housing 29 is journalled a pump shaft 32 connected at one end to and driven by the fluid motor 12, as will appear, and a pump impeller 34 is fixed on the threaded end of the pump shaft 32 by shoulder 32*a*, key 32*b* and by nut means 32*c* and is rotationally driven by the fluid motor 12.

A plurality of circumferentially spaced stators 33 are located within the bearing and stator housing 22 and a plurality of circumferentially spaced stators 35 are fixed within the stator housing 23. Stators 33 and 35 act to straighten out the flow of water through the pump assembly.

Figure 2:
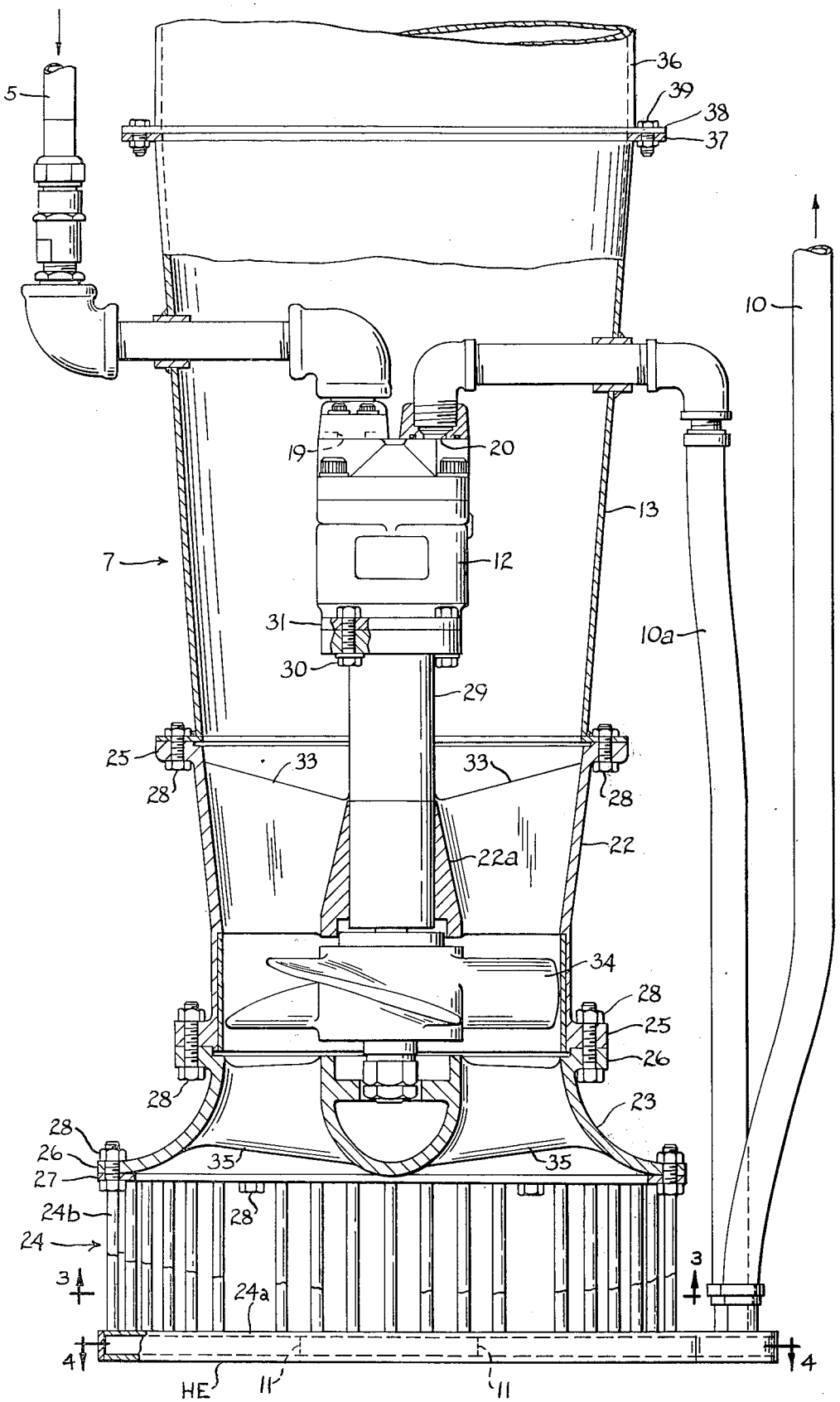
FIG. 2 is an enlarged view, partially in section, and with certain parts broken away, of a portion of the apparatus shown in FIG. 1, namely the pump assembly.
Figure 3:
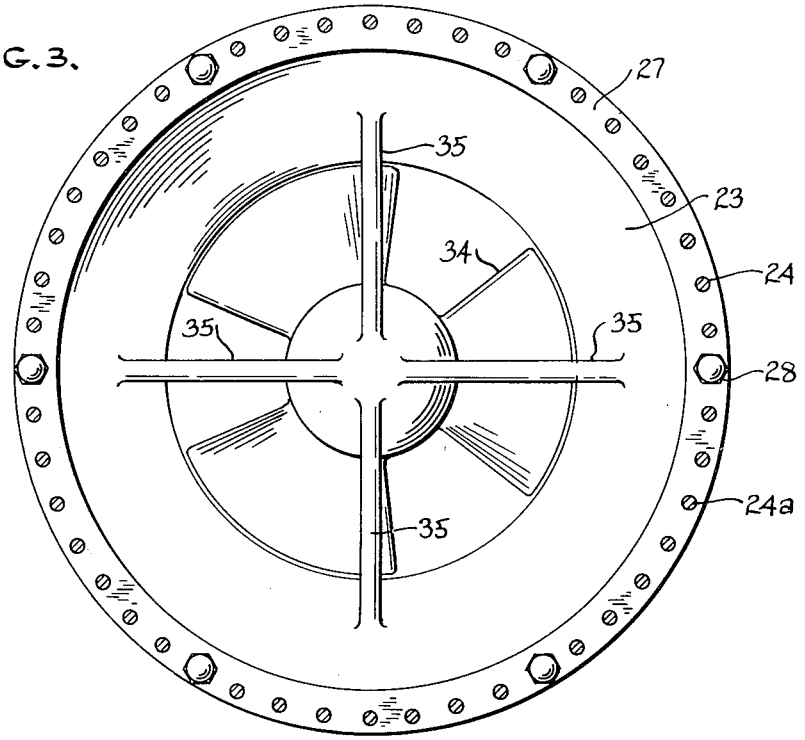
FIG. 3 is a sectional view taken generally along the line 3—3 in FIG. 2.
Figure 4:
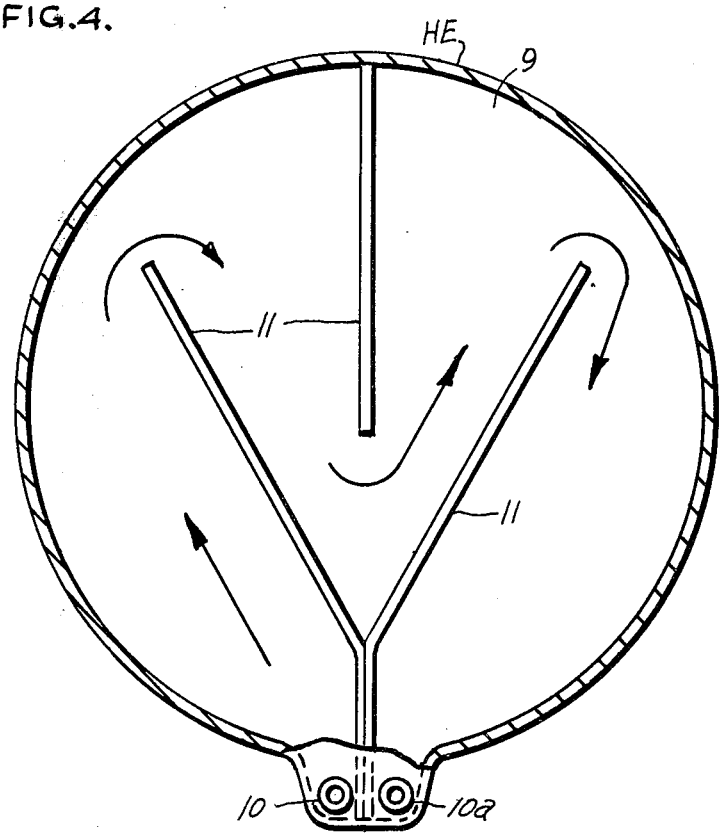
FIG. 4 is a sectional view taken along the line 4—4 in FIG. 2.

The water pump assembly 7 is located down in the bottom of the excavation, vessel or other area to be pumped out, and the pressure fluid pump 2 is connected to the fluid motor 12 of the pump assembly 7 by the long flexible hoses such as conduits 5 and 10. The water is pumped through the discharge housing 13 of the pump assembly and into a long flexible discharge pipe 36. The pipe 36 is quickly attachable to the pump assembly 7 by means of the flanges 37 and 38 (FIG. 2) of the discharge housing 13 and discharge pipe 36, respectively, which flanges are held together by the bolt means 39. The discharge pipe 36 extends upwardly out of the area to be dewatered and to a remote location, if necessary, for discharge of the water, trash, sludge, rocks, or the like.

The fluid motor 12, which is driven by the pressure fluid pump 2, is of itself of conventional character and is a positive displacement, gear type motor, for example, in which intermeshing gears are rotatably driven by pressure fluid and act to drive an output 40 of the motor.

I claim:

1. Dewatering pumping apparatus comprising, a power source, a fluid tank assembly including a pressure fluid pump connected to and driven by said power source, a pump assembly for being located in a hole to be dewatered and including a housing having a lower end, a pressure fluid motor carried by said housing, fluid conduits connected between said motor and said tank assembly for conducting pressure fluid therebetween to drive said motor, an impeller in said housing and connected to said motor for being rotationally driven by said motor to thereby pump water from said hole, said pump assembly having a heat exchanger fixed to said lower end of said housing and including a chamber for receiving pressure fluid, and conduit fluid means connecting said, fluid motor and said heat exchanger.

2. A dewatering pump assembly comprising a generally tubular housing having a lower end, said housing having stator means therein, a bearing housing connected to said tubular housing and mounted on said stator means and concentrically with said tubular housing, a fluid motor connected to one end of said bearing housing, a pump shaft extending through said bearing housing and connected at one end to said fluid motor, a water pumping impeller in said generally tubular housing and secured to the other end of said pump shaft for being driven by said fluid motor, a heat exchanger secured to said lower end tubular housing and defining a chamber for pressure fluid, and fluid conduit means connected between said fluid motor and said heat exchanger.

3. The assembly set forth in claim 2 further characterized in that said heat exchanger includes a pair of spaced apart plates defining said chamber therebetween.

4. A dewatering pump assembly comprising a generally tubular housing, said housing having stator means therein, a fluid motor mounted in said housing, a pump shaft in said housing and connected at one end to said fluid motor, a water pumping impeller in said generally tubular housing and secured to the other end of said pump shaft for being driven by said fluid motor, said tubular housing having an intake end, an intake grill around and extending from said intake end, and a heat exchanger secured to said grill and forming a closure plate for said intake end, said heat exchanger defining a chamber for pressure fluid, and fluid conduit means connected between said fluid motor and said chamber.

5. The assembly set forth in claim 4 further characterized in that said heat exchanger includes a pair of spaced apart plates defining said chamber therebetween.

6. A dewatering pump assembly comprising a generally tubular housing having a lower end and an upper end, a bearing housing connected to said upper end of said tubular housing extending upwardly therefrom and concentrically with said tubular housing, a fluid motor connected to one end of said bearing housing, a pump shaft extending through said bearing housing and connected at one end to said fluid motor, a water pumping impeller in said generally tubular housing and secured to the other end of said pump shaft for being driven by said fluid motor, a heat exchanger secured to said lower end of said tubular housing and defining a chamber for pressure fluid, and fluid conduit means connected between said fluid motor and said heat exchanger.

7. Apparatus as set forth in claim 1 further characterized in that said heat exchanger comprises a pair of spaced apart and substantially parallel, flat plates defining said heat exchanger chamber.

* * * * *